US005314861A

United States Patent [19]

Morohoshi et al.

[11] Patent Number: 5,314,861

[45] Date of Patent: May 24, 1994

[54] SUBLIMATION TYPE THERMAL IMAGE TRANSFER IMAGE RECEIVING MEDIUM

[75] Inventors: Naoya Morohoshi; Hiroyuki Uemura, both of Numazu; Chiharu Nogawa, Shizuoka, all of Japan

[73] Assignee: Ricoh Company, Ltd., Tokyo, Japan

[21] Appl. No.: 958,762

[22] Filed: Oct. 9, 1992

[30] Foreign Application Priority Data

| | | | |
|---|---|---|---|
| Oct. 9, 1991 | [JP] | Japan | 3-262000 |
| Oct. 11, 1991 | [JP] | Japan | 3-292215 |
| Nov. 28, 1991 | [JP] | Japan | 3-314535 |
| Dec. 19, 1991 | [JP] | Japan | 3-355101 |
| Jul. 16, 1992 | [JP] | Japan | 4-212096 |

[51] Int. Cl.[5] ..... B41M 5/035; B41M 5/38

[52] U.S. Cl. ..... 503/227; 428/195; 428/212; 428/213; 428/447; 428/913; 428/914

[58] Field of Search ..... 503/200, 226, 227; 427/152; 8/471; 428/195, 212, 213, 447, 913, 914

[56] References Cited

U.S. PATENT DOCUMENTS

| | | | |
|---|---|---|---|
| 4,778,782 | 10/1988 | Ito et al. | 503/227 |
| 4,971,950 | 11/1990 | Kato et al. | 503/227 |

*Primary Examiner*—B. Hamilton Hess

*Attorney, Agent, or Firm*—Oblon, Spivak, McClelland, Maier & Neustadt

[57] ABSTRACT

A sublimation type thermal image transfer image receiving medium is composed of a substrate and a dye receiving layer formed thereon, and the substrate is composed of a first laminated sheet on which the dye receiving layer is provided and a second laminated sheet, with an elastic adhesive layer or a plastic adhesive layer being interposed between the first laminated sheet and the second laminated sheet.

22 Claims, 3 Drawing Sheets

SUBLIMATION TYPE THERMAL IMAGE TRANSFER IMAGE RECEIVING MEDIUM

BACKGROUND OF THE INVENTION

1. Field of the Invention

The present invention relates to a sublimation type thermal image transfer image receiving medium capable of receiving a dye from a thermal image transfer recording medium, to produce an image with high resolution using a printer which needs a large quantity of thermal energy, such as a sublimation type thermal image transfer printer.

2. Discussion of Background

A thermal image transfer recording system is carried out in such a manner that a thermal image transfer recording medium which comprises a dye-transfer layer containing a dye and/or pigment is superimposed upon an image receiving medium capable of receiving the dye caused to sublime from the dye-transfer layer of the recording medium or receiving the fused portion of the dye-transfer layer when the thermal image transfer recording medium is heated from the back side thereof. In particular, a sublimation-type thermal image transfer recording system can produce a full-color hard copy with an excellent half tone, so that it is greatly attracting public attention now.

In the conventional image receiving medium for us in the sublimation-type thermal image transfer recording system, a dye-receiving layer is formed on a substrate, which dye-receiving layer comprises a thermoplastic resin such as a polyester resin, which can be readily dyed with a heat-sublimable dye, and a releasant. However, the conventional image receiving medium employing a substrate of a single-layered type, such as a sheet of synthetic paper or a plastic film is easily curled when the thermal energy is applied thereto by using a thermal head in the course of thermal image transfer recording. As a result, the transporting performance of the image-receiving medium becomes unsatisfactory in the thermal image transfer recording apparatus.

To improve the transporting performance of the image-receiving medium in the recording apparatus, a three-layer laminated material prepared by laminating a sheet of synthetic paper, a sheet of cellulose fiber paper and a sheet of synthetic paper is used as a substrate of the image receiving medium as disclosed in Japanese Laid-Open Patent Application 62-198497. The transporting performance of the image receiving medium thus obtained is improved because the curling problem is solved to some extent. However, the curling preventing effect in the aforementioned disclosure is not sufficient in practice when the image receiving medium is used in the latest high-speed thermal image transfer recording apparatus.

There is proposed in Japanese Laid-Open Patent Application 63-107587 an image receiving medium for the purpose of forming a light transmitting original thereon for use with an OHP (overhead projector). This image receiving medium comprises a transparent substrate, a transparent image-receiving layer formed on the substrate and a release sheet such as a sheet of synthetic paper, a sheet of cellulose fiber paper or a synthetic resin sheet with a rough surface, formed on the back side of the substrate, opposite to the image-receiving layer with respect to the substrate. The above-mentioned release sheet can be released from the substrate after an image is thermally transferred to the image receiving medium or before the obtained image is projected using the OHP.

The curling of the above-mentioned image receiving medium can be decreased and the transporting performance thereof is improved due to attachment of the release sheet to the substrate. After the release sheet is peeled from the substrate, however, the curling is still a serious problem. Therefore, when the image-receiving medium is used as an image-receiving film for use with the OHP, handling is inconvenient and the projected image is distorted.

In addition, when the image-receiving layer of the image receiving medium comprises a resin such as vinyl chloride resin, the adhesion between the substrate and the image-receiving layer is poor, so that the image-receiving layer is easily peeled from the substrate.

SUMMARY OF THE INVENTION

Accordingly, an object of the present invention is to provide a sublimation type thermal image transfer image receiving medium provided with excellent transporting performance in a thermal image transfer recording apparatus, with the curling problem caused by the application of heat from a thermal head minimized in the course of thermal image transfer recording.

Another object of the present invention is to provide a sublimation type thermal image transfer image receiving medium serving as a transparent image receiving medium capable of forming a light transmitting original thereon which is not distorted when projected by using the OHP.

A further object of the present invention is to provide a sublimation type thermal image transfer image receiving medium in which an image-receiving layer is not peeled from a substrate.

The above-mentioned objects of the present invention can be achieved by a sublimation type thermal image transfer image receiving medium comprising a substrate and a dye receiving layer formed thereon, the substrate comprising a first laminated sheet on which the dye receiving layer is provided and a second laminated sheet, with an elastic adhesive layer or a plastic adhesive layer interposed between the first and second laminated sheets.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The sublimation type thermal image transfer image receiving medium of the present invention will now be explained in detail by referring to FIGS. 1 to 3.

Figure 1:
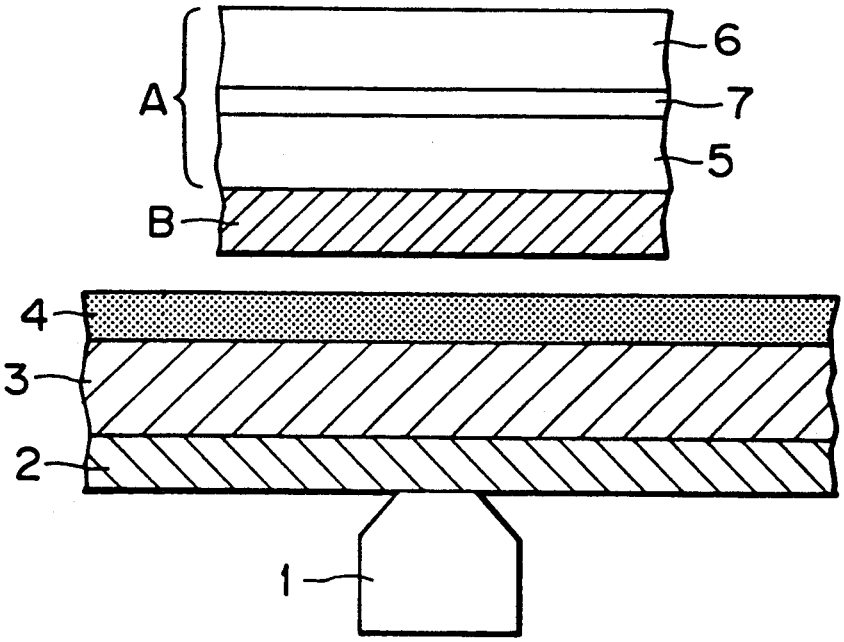
FIG. 1 is a schematic cross-sectional view of one embodiment of a sublimation type thermal image transfer image receiving medium of the present invention.

The sublimation type thermal image transfer image receiving medium of the present invention as shown in FIG. 1 comprises a substrate A and a dye receiving layer B. The substrate A comprises a first laminated sheet 5 and a second laminated sheet 6, with an elastic adhesive layer or a plastic adhesive layer 7 being interposed therebetween and the dye receiving layer B being provided on the first laminated sheet 5.

A sublimation type thermal image transfer recording medium comprises a support 3, a dye transfer layer 4 comprising a heat-sublimable dye, formed on the support 3, and a heat-resistant layer 2 formed on the back side of the support 3, opposite to the dye transfer layer 4 with respect to the support. When the thermal energy is applied to the sublimation type thermal image transfer recording medium by a thermal head 1, the heat-sublimable dye contained in the dye transfer layer 4 of the recording medium is caused to sublime and transferred to the dye receiving layer B of the image receiving medium of the present invention.

Figure 2:
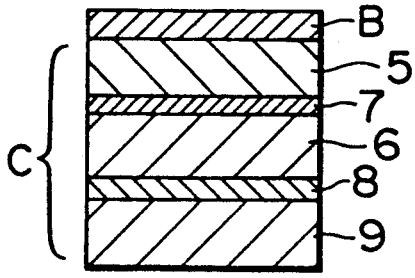
FIG. 2 is a schematic cross-sectional view of another embodiment of a sublimation type thermal image transfer image receiving medium of the present invention.

FIG. 2 is a cross-sectional view of another embodiment of the sublimation type thermal image transfer image receiving medium of the present invention.

The sublimation type thermal image transfer image receiving medium as shown in FIG. 2 comprises a substrate C and a dye receiving layer B. The substrate C comprises a first laminated sheet 5 and a second laminated sheet 6, with an elastic adhesive layer or a plastic adhesive layer 7 being interposed therebetween and the dye receiving layer B being provided on the first laminated sheet 5, and further comprises a third laminated sheet 9, with an adhesive layer 8 being interposed between the the second laminated sheet 6 and the third laminated sheet 9.

Figure 3:
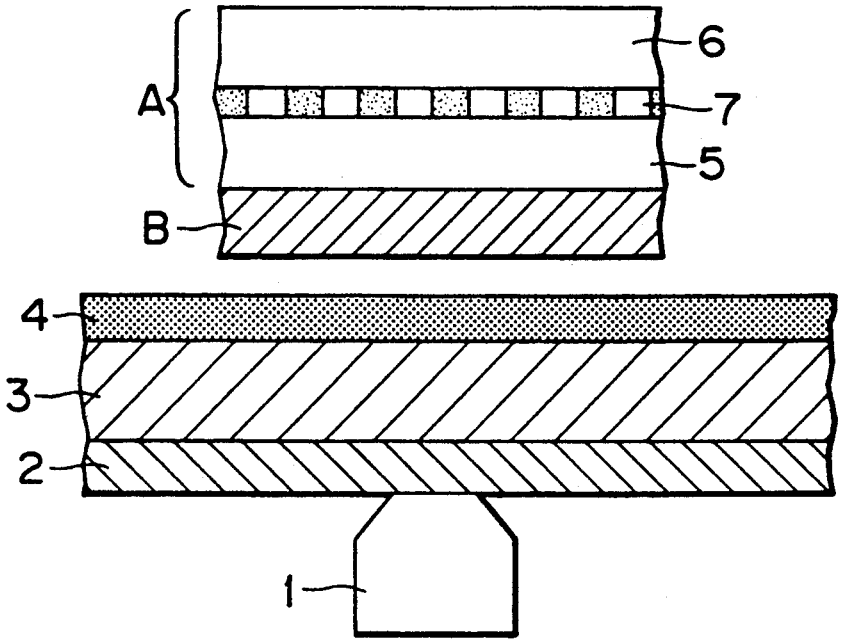
FIG. 3 is a schematic cross-sectional view of a further embodiment of a sublimation type thermal image transfer image receiving medium of the present invention.
Figure 4A:
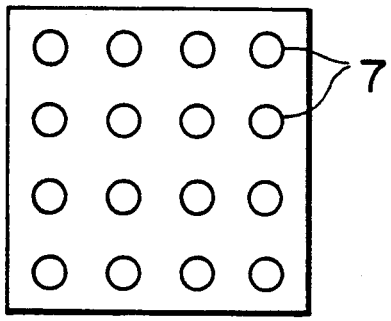
FIGS. 4(*a*) through 4(*d*) are plan views showing the coating patterns of the elastic adhesive or plastic adhesive when the elastic adhesive layer or plastic adhesive layer is partially provided between a first laminated sheet and a second laminated sheet of a sublimation type thermal image transfer image receiving medium of the present invention as shown in FIG. 3.
Figure 4B:
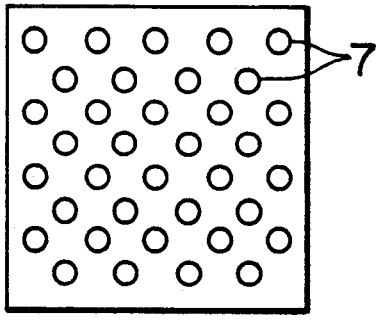
Figure 4C:
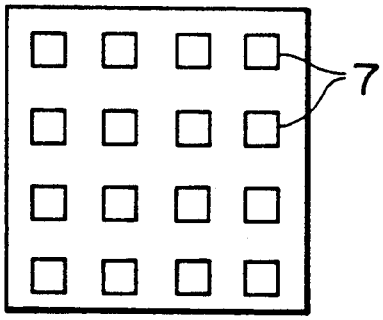
Figure 4D:
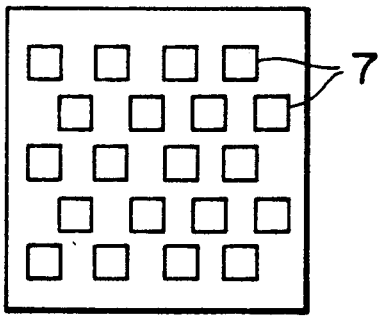

FIG. 3 is a cross-sectional view of a further embodiment of the sublimation type thermal image transfer image receiving medium of the present invention, a substrate A of which comprises a first laminated sheet 5 and a second laminated sheet 6, with an elastic adhesive layer or a plastic adhesive layer 7 being partially provided therebetween, and a dye receiving layer B is provided on the first laminated sheet 5.

As shown in FIG. 1 through FIG. 3, the substrate of the sublimation type thermal image transfer image receiving medium according to the present invention comprises at least two laminated sheets, with an elastic adhesive layer or a plastic adhesive layer interposed between those laminated sheets. Owing to such a laminated structure of the substrate, the curling of the image receiving medium can be minimized when thermal energy is applied thereto by a thermal head in the course of thermal image transfer recording.

The curling prevention effect is supposed to result from:

(1) The first laminated sheet attached to the dye receiving layer necessarily becomes thinner than the conventional single-layer substrate when the total thickness of the laminated-substrate is desired to be equal to that of the single-layer substrate. Therefore, the shrinkage stress caused by the application of heat can be decreased.

(2) The heat shrinkage stress generated in the first laminated sheet can be relaxed by the elastic adhesive layer or plastic adhesive layer interposed between the first laminated sheet and the second laminated sheet.

Furthermore, when the elastic adhesive layer or plastic adhesive layer is partially provided between the first and second laminated sheets, not only the heat shrinkage stress is relaxed by the elastic adhesive layer or plastic adhesive layer, but also the elastic adhesive layer or plastic adhesive layer effectively prevents the shrinkage stress from conducting to the second laminated sheet.

When each of the first and second laminated sheets becomes thicker, the curling problem can be solved more satisfactorily. An appropriate thickness of each laminated sheet may be determined with the manufacturing cost and the transporting performance of the obtained image receiving medium taken into consideration. In the present invention, it is preferable that the second laminated sheet be thicker than the first laminated sheet.

The larger the rigidity of the substrate of the image receiving medium, the less the occurrence of the curling problem. An appropriate rigidity of each laminated sheet may be determined with the transporting performance of the obtained image receiving medium taken into consideration. For the first laminated sheet on which the dye receiving layer is provided, a sheet of synthetic paper with excellent cushioning characteristics, and a film including voids therein, for example, an expanded PET film are conventionally employed to improve the image uniformity and image density. The aforementioned materials for the first laminated sheet have a small rigidity. In the present invention, it is preferable that the rigidity of the second laminated sheet is larger than that of the first laminated sheet.

In general, the substrate with a small heat shrinkage ratio can contribute to the prevention of curling of the image receiving medium. When a film including voids therein is used as the first laminated sheet in the present invention, as previously mentioned, the heat shrinkage ratio of this first laminated sheet is high. In the present invention, therefore, it is recommendable that the second laminated sheet have a smaller heat shrinkage ratio than that of the first laminated sheet.

When the thermal conductivity of a surface portion of the substrate, which is adjacent to the dye receiving layer, is low, the thermal energy can easily be concentrated in the dye receiving layer, thereby increasing the density of the transferred image; and in addition, the heat conduction to a bottom portion of the substrate can be decreased, thereby preventing the curling problem of the image receiving medium. In the present invention, therefore, it is preferable that the first laminated sheet on which the dye receiving layer is provided have a smaller thermal conductivity than that of the second laminated sheet.

For each of the first and second laminated sheets constituting the substrate of the image receiving medium according to the present invention, a plastic film such as a film of polyethylene, polypropylene, polyvinyl chloride, polyvinylidene chloride, polyvinyl alcohol, polyethylene terephthalate, polycarbonate, nylon, polystyrene, ethylene - vinyl acetate copolymer, ethylene - vinyl alcohol copolymer, polyethylene naphthalate, fluorinated ethylene propylene, aromatic polyamide, polyarylate, polyether sulfone, polyether imide, polyimide, acrylic resin and ionomer; and a sheet of cellulose fiber paper such as high quality paper, ordinary paper, Japanese paper, tissue paper and coat paper can be employed. The substrate of the image receiving medium according to the present invention comprises at least two laminated sheets, with an elastic adhesive layer or a plastic adhesive layer interposed between those laminated sheets. The materials for the two laminated sheets may be the same or different.

In addition, each laminated sheet may contain voids therein or not. To prepare such a voids-containing film, a mixture of a resin and an expanding agent may be extruded through an orifice to form a film, or a resin may be subjected to orientation with the addition of finely-divided particles to generate voids in the obtained film.

As a voids-containing film, for instance, a biaxially oriented multilayered film mainly comprising a polyolefin resin and an inorganic pigment can be prepared by stretching the polyolefin resin such as polyethylene or polypropylene with the addition of finely-divided particles of the inorganlc pigment such as titanium dioxide or calcium carbonate. In this case, a proper content of the inorganic pigment is 3 to 80 wt. % of the total weight of the obtained film.

In the case where one of the laminated sheets constituting the substrate of the image receiving medium is a voids-containing film, it is preferable to provide the dye receiving layer on the voids-containing sheet because the curling of the obtained image receiving medium can be effectively prevented.

The preferable example of the above-mentioned voids-containing film is an air-bubble-containing film with a heat shrinkage ratio of 6% or less both in the lengthwise direction and the crosswise direction when measured in accordance with JIS C-2318. To obtain such an air-bubble-containing film, the voids-containing film may be further subjected to heat setting so as to decrease the heat shrinkage ratio of the film. More specifically, the film may be brought into contact with a heat-application roller to relax the orientation release stress retained in the film. Thus, the heat shrinkage ratio of the film can be decreased.

It is more preferable that the heat shrinkage ratio of the air-bubble-containing film be 2.5% or less both in the lengthwise direction and the crosswise direction. This is because the curling of the image receiving medium can be more effectively prevented even when a large quantity of thermal energy is applied thereto to carry out the thermal image transfer recording.

The most preferable example of the voids-containing sheet is an air-bubble-containing PET film. The air-bubble-containing PET film has a small heat shrinkage ratio and high whiteness degree, so that the treatment for decreasing the heat shrinkage ratio, such as heat setting, is not required, and it is not necessary to add a fluorescent whitening agent or white pigment for adjusting the whiteness degree of the obtained film in the course of film-formation.

It is preferable that the density $D_2$ of the air-bubble-containing film for use in the present invention and the density $D_1$ of an air-bubble free film made of the same material as that of the air-bubble-containing film be in the relationship of:

$$\frac{D_1 - D_2}{D_1} > 0.03.$$

As previously mentioned, the air-bubble-containing film is preferably employed as the laminated sheet of the substrate because the curling of the image receiving medium can be prevented. Furthermore, images with high image density can be obtained even when the thermal image transfer recording is performed at a low thermal energy. Specific examples of the material for use in the air-bubble-containing film are polyester, vinyl chloride, polycarbonate, polypropylene, polyethylene and acetate. Of those materials, polyester and polypropylene are more preferable.

When the substrate comprises three laminated sheets as shown in FIG. 2, the first laminated sheet 5 on which the dye receiving layer B is provided, and the third laminated sheet 9 may preferably be subjected to the treatment for decreasing heat shrinkage ratio thereof, for example, heat setting treatment, to such a degree that the heat shrinkage ratio in the lengthwise direction of each sheet is decreased to 0.2% or less at 100° C. in the heat stretchability test in accordance with JIS K-6734. Thus, the curling of the obtained image receiving medium can be further efficiently prevented.

It is preferable that the second laminated sheet 6 provided between the first laminated sheet 5 and the third laminated sheet 9 as shown in FIG. 2 have a heat shrinkage ratio of 0.1% or in the lengthwise direction at 100° C. in the heat stretchability test in accordance with JIS K-6734. In addition, the heat shrinkage ratio of the second laminated sheet is preferably ½ or less that of the first or third laminated sheet.

It is preferable that each of the laminated sheets constituting the substrate of the image receiving medium according to the present invention have a thickness of about 5 to 300 μm, more preferably about 20 to 200 μm.

The sublimation type thermal image transfer image receiving medium of the present invention for use with the OHP is required to have light transmission properties, so that transparent films may be used as the laminated sheets constituting the substrate, and a transparent dye receiving layer may be formed on the transparent substrate. The transparent films, serving as the laminated sheets, may be selected from the aforementioned films. It is preferable that the haze value of each transparent film be 10% or less, more preferably 5% or less. The aforementioned haze value is a value determined in accordance with American National Standard ASTM D1003.

In the thermal image transfer image receiving medium of the present invention for use with the OHP, at least two transparent films are laminated with the elastic adhesive layer or plastic adhesive layer interposed therebetween, thereby constituting the substrate. Therefore, the transparent image receiving medium does not curl when the thermal energy is applied thereto by the thermal head in the course of thermal image transfer recording. In addition, since this image receiving medium is transparent, it can be used as it is without peeling the release sheet from the substrate. Furthermore, the image projected by use of the OHP is not distorted.

In the case where two transparent films are laminated to form a transparent substrate, with the elastic adhesive layer or plastic adhesive layer being interposed between two films, a ratio of the thickness of the second transparent laminated film to that of the first transparent laminated film on which the transparent dye receiving layer is provided is preferably 1.1 or less. When the thickness ratio is within the above range, the curling of the image receiving medium can be prevented, and the smoothness of a surface portion of the transparent dye receiving layer can be maintained, and consequently, the sharpness of images projected by using the OHP cannot be impaired.

The elastic adhesive layer or plastic adhesive layer can be formed by coating an elastic adhesive agent or plastic adhesive on the laminated sheet in accordance with a conventional method.

The plastic adhesive for use in the present invention is one of the adhesives, and the cohesive force of the plastic or elastic adhesive for use in the present invention is comparatively small, and in addition, the plastic adhesive and the elastic adhesive for use in the present invention can readily absorb and relax the stress. Even though the heat shrinkage stress is generated in the dye receiving layer and the first laminated sheet on which the dye receiving layer is provided when the thermal energy is applied thereto by the thermal head in the thermal image transfer recording operation, the above-mentioned elastic adhesive layer or plastic adhesive layer is capable of absorbing such a heat shrinkage stress. In addition to the above function of the elastic adhesive layer or plastic adhesive layer, the high rigidity of the second laminated sheet which is attached to the first laminated sheet via the elastic adhesive layer or plastic adhesive layer can contribute to the prevention of curling of the image receiving medium.

Any of the conventionally known plastic adhesives can be used for the plastic adhesive layer in the present invention. The plastic adhesive with a viscoelastic behavior basically comprises a polymeric elastic material and a tackifier. Furthermore, a tackiness controlling agent, an adhesive modifier and other additives such as an aging preventing agent, a stabilizer and a coloring agent may be added to impart various resistances to the obtained adhesive.

Examples of the polymeric elastic material for use in the plastic adhesive are natural rubber, styrene - butadiene copolymer, isoprene polymer, butadiene polymer, chloroprene polymer, acrylic acid ester copolymer, vinyl ether copolymer, ethylene - vinyl acetate copolymer (EVA) resin, polyisobutylene, polyurethane and siloxane-crosslinked polymer.

Examples of the tackifier for use in the plastic adhesive include tackifier resins such as rosin, dammar, copal, hydrogenated rosin, coumarone-indene resin, polyterpene, phenolic resin, alkyd resin, petroleum hydrocarbon resin, xylene resin and epoxy resin; plasticizers such as phthalate ester, phosphate ester and paraffin chloride; softeners such as animal fats and oils, vegetable fats and oils and mineral oil; and oligomers corresponding to the above-mentioned polymeric materials.

As the elastic adhesive for use in the present invention, any conventional elastic adhesives can be employed. In particular, an elastic adhesive which shows a Young's modulus of 1 to 2,000 kg/cm$^2$ when formed in an elastic adhesive layer is preferred in the present invention. The elastic adhesive mainly comprises a polymeric elastic material, and may further comprise an adhesive modifier, an aging preventing agent and a stabilizer when necessary.

The elastic adhesive comprising as the main component a synthetic rubber or a siloxane-crosslinked polymer is preferably used because the capacity to absorb the stress is excellent.

As the elastic adhesive comprising the siloxane-crosslinked polymer, for example, a composition comprising an epoxy resin, and a liquid polymer with a backbone structure of polyoxypropylene, having an amino group which is reactive to an epoxy group and a moisture-curing silyl group can be employed.

In addition to the above, preferable another example of the elastic adhesive is a composition comprising a silanol condensation catalyst and a polyoxytetramethylene glycol based polymer which has at least one silicon-atom-containing group (hereinafter referred to as a reactive silicon group) having a hydroxyl group or a hydrolyzable group bonded to a silicon atom, which reactive silicon group is capable of crosslinking by forming a siloxane bond.

A representative example of the above-mentioned reactive silicon group is as follows:

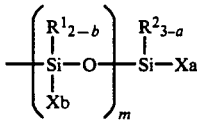

wherein $R^1$ and $R^2$ each represent an alkyl group having 1 to 20 carbon atoms, an aryl group having 6 to 20 carbon atoms, an aralkyl group having 7 to 20 carbon atoms or a triorganosiloxy group represented by $(R')_3SiO$—, in which R' represents a monovalent hydrocarbon group having 1 to 20 carbon atoms and three of R' may be the same or different;

X represents a hydroxyl group or a hydrolyzable group; a is an integer of 0 to 3; b is an integer of 0 to 2; and m is an integer of 0 to 19, provided that when there is a plurality of $R^1$ or $R^2$, each of $R^1$ or $R^2$ may be the same or different.

In the above formula of the reactive silicon group, preferable examples of the hydrolyzable group represented by X are hydrogen, a halogen, an alkoxyl group, an acyloxy group, an amino group and an amide group.

It is preferable to allow at least one unit, more preferably, 1 to 5 units of the reactive silicon group to exist in one molecule of the polyoxytetramethylene glycol based polymer. In this case, the curing characteristics of the obtained product are sufficient.

A polymer constituting a backbone structure of the polyoxytetramethylene glycol based polymer having the reactive silicon group can be prepared, for example, in accordance with the cationic ring-opening-polymerization of tetrahydrofuran. It is preferable that the number-average molecular weight of the polymer constituting the backbone of the polyoxytetramethylene glycol based polymer be about 500 to 30,000.

For introducing the reactive silicon group into the polymer forming the backbone structure of the polyoxytetramethylene glycol based polymer, for example, a polyoxytetramethylene glycol based polymer having a functional group such as a hydroxyl group at the end or in the main chain thereof may be allowed to react with an organic compound having an active group and an unsaturated group which are reactive to the above-mentioned functional group to obtain a reaction product.

The reaction product thus obtained may be allowed to react with hydrosilane having a hydrolyzable group.

For the previously mentioned silanol condensation catalyst for use in the elastic adhesive, conventional silanol condensation catalysts are usable.

Examples of the silanol condensation catalyst are titanates such as tetrabutyl titanate and tetrapropyl titanate; tin carboxylate such as dibutyltin dilaurate, dibutyltin maleate, dibutyltin diacetate, tin octylate and tin naphthenate; a reaction product of dibutyltin oxide and phthalate; dibutyltin diacetylacetonate; organic aluminum compounds such as aluminum trisacetylacetonate, aluminum trisethylacetoacetate and diisopropoxy aluminum ethylacetoacetate; chelate compounds such as zirconium tetraacetylacetonate and titanium tetraacetylacetonate; lead octylate; amine compounds such as butylamine, octylamine, dibutylamine, monoethanolamine, diethanolamine, triethanolamine, diethylenetriamine, triethylenetetramine, oleylamine, cyclohexylamine, benzylamine, diethylaminopropylamine, xylylenediamine, triethylenediamine, guanidine, diphenylguanidine, 2,4,6-tris(dimethylaminomethyl)phenol, morpholine, N-methylmorpholine, 2-ethyl-4-methylimidazole, 1,8-diazabicyclo(5,4,0)undecene-7(DBU) and a salt of the above-mentioned amine compound and a carboxylic acid; a low-molecular-weight polyamide resin obtained from surplus polyamine and a polybasic acid; a reaction product of surplus polyamine and an epoxy compound; and silane coupling agents having an amino group such as $\gamma$-aminopropyl trimethoxysilane and N-($\beta$-aminoethyl)aminopropyl methyldimethoxysilane. In addition, other basic catalysts and acid catalysts which are conventionally known can be used. Those catalysts can be used alone or in combination.

It is preferable that the amount of the aforementioned silanol condensation catalyst be about 0.1 to 20 parts weight of 100 parts by weight of the polyoxytetramethylene glycol based polymer.

The above-mentioned plastic adhesives and elastic adhesives are coated on a sheet by the conventional method such as hot-melt coating after adjusted to obtain an appropriate viscosity with the addition thereto of water or an organic solvent when necessary. Thus, an elastic adhesive layer or a plastic adhesive layer is formed.

It is preferable that the thickness of the elastic adhesive layer or plastic adhesive layer be about 0.1 to 60 $\mu$m, more preferably 1 to 50 $\mu$m. When the thickness is within the above range, the elastic adhesive layer or plastic adhesive layer can effectively contribute to the prevention of curling of the obtained image receiving medium, and at the same time, squeeze-out of the elastic adhesive or plastic adhesive can be avoided when the sheets are laminated.

When three sheets are laminated to constitute the substrate of the image receiving medium as shown in FIG. 2, the third laminated sheet 9 may be attached to the second laminated sheet 6 with not only the previously mentioned elastic adhesives and plastic adhesives, but also other conventional adhesives.

Examples of the conventional adhesive used in laminating the second laminated sheet 6 and the third laminated sheet 9 include urea resin, melamine resin, phenolic resin, epoxy resin, vinyl acetate resin, vinyl acetate - acryl copolymer resin, ethylene - vinyl acetate copolymer (EVA) resin, acrylic resin, polyvinyl ether resin, vinyl chloride - vinyl acetate copolymer resin, polystyrene resin, polyester resin, polyurethane resin, polyamide resin, chlorinated polyolefin resin, polyvinyl butyral resin, acrylic ester copolymer resin, methacrylic ester copolymer resin, natural rubber, cyanoacrylate resin, and silicone resin. A proper tackifier may be added to those adhesives. Furthermore, a plasticizer, a filler and an aging preventing agent may be added when necessary.

The elastic adhesive layer or the plastic adhesive layer may be partially provided between the laminated sheets as shown in FIG. 3. To partially form the elastic adhesive layer or the plastic adhesive layer, spray coating or gravure coating is available. In the gravure coating, the elastic adhesive or plastic adhesive applied to the intaglio of a coating roll is transferred to the laminated sheet using a doctor, with the pressure of a nip roll applied to the laminated sheet. This gravure coating is preferred in the present invention because uniform coating amount of the elastic adhesive or plastic adhesive can easily be obtained and the coating pattern can be freely selected. The coating patterns of the elastic adhesive or plastic adhesive on the first laminated sheet of the sublimation type thermal image transfer image receiving medium of the present invention are illustrated in FIGS. 4(*a*) through 4(*d*).

The dye receiving layer B of the sublimation type thermal image transfer image receiving medium of the present invention, which serves to receive the heat-sublimable dye which is caused to sublime from the thermal image transfer recording medium, comprises a resin which can be dyed with the above-mentioned heat-sublimable dye or an inorganic material in the form of a film.

Examples of the resin for use in the dye receiving layer B include polyester resin, vinyl chloride resin, vinyl acetate resin, polycarbonate resin, butyral resin, epoxy resin, polycaprolactone resin, styrene resin, polyacrylonitrile resin, polyamide resin, and silicone-modified polyester resin. Those resins can be used alone or in combination, and copolymers of the monomers employed in the above-mentioned resins can also be used. In addition, a cure product obtained by the reaction between the abovementioned resins and a crosslinking agent or curing agent; and a radiation curing resin may be used.

Furthermore, the dye receiving layer B of the image receiving medium may comprise silicone resin, silicone oil, polyester-modified silicone resin, polyester-modified dimethylsiloxane and various fluorine-containing resins in order to prevent the dye receiving layer B of the image receiving medium from fusing and sticking to the dye transfer layer 4 of the thermal image transfer recording medium. It is preferable that the amount of the above material capable of preventing the sticking of the dye receiving layer to the dye transfer layer be about 0.1 to 30 wt. % of the total weight of the resin contained in the dye receiving layer.

The dye receiving layer B may further comprise as a filler, a pigment such as silica, titanium oxide or calcium carbonate and finely-divided particles of a resin. In addition, a surface active agent, an ultraviolet absorbing agent and antioxidant may be appropriately contained in the dye receiving layer B.

In the case where the image receiving medium of the present invention is used as a transparent image receiving medium for use with the OHP, it is preferable that the dye receiving layer comprise a pigment to such a degree that the transparency of the image receiving medium is not impaired, that is, the haze value of the image receiving medium is 10% or less, more preferably 5% or less.

For the purpose of preventing the dye receiving layer B of the transparent image receiving medium from fusing and sticking to the dye transfer layer 4 of the thermal image transfer recording medium, an overcoat layer may be provided on the dye receiving layer B. Furthermore, an intermediate layer may be interposed between the dye receiving layer B and the substrate A in order to improve the adhesion. The dye receiving layer B may be of a single-layered type or multi-layered type. An antistatic layer may be further overlaid on the dye receiving layer B or the above-mentioned overcoat layer.

Examples of the resin for use in the intermediate layer are polyester resin, butyral resin, vinyl chloride resin, vinyl acetate resin, epoxy resin, and vinyl resin. Those resins can be used alone or in combination, and copolymers of the monomers employed in the above-mentioned resins are usable. In particular, a resin having a polar group such as a hydroxyl group or a carboxyl group is preferably used in the intermediate layer because the adhesion between the substrate and the resin for use in the dye receiving layer can be improved. In addition, a cure product obtained by the reaction between the above-mentioned resins and a crosslinking agent or curing agent; and a radiation curing resin may be used for the intermediate layer.

It is preferable that the intermediate layer comprise a resin having a hydroxyl group and an isocyanate compound in the present invention. Due to such an intermediate layer, the adhesion between the substrate and the dye receiving layer can be increased, and in addition, the sticking of the dye receiving layer of the image receiving medium to the dye transfer layer of the thermal image transfer recording medium can be prevented, that is, the releasability of the dye receiving layer can be improved.

Specific examples of the above-mentioned resin having a hydroxyl group include polyester resin and polyvinyl-alcohol-modified vinyl chloride - vinyl acetate copolymer, and commercially available products, "Vylon 200" and "Vylon 600" (Trademark) made by Toyobo Co., Ltd.; "VAGH" and "VROH" (Trademark) made by Union Carbide Japan K.K.; and "Denka Vinyl 1000GKT", "Denka Vinyl 1000GK" and "Denka Vinyl 1000KGS" (Trademark) made by Denki Kagaku Kogyo K.K.

Examples of the isocyanate compound for use in the intermediate layer include tolylene diisocyanate, hexamethylene diisocyanate, 4,4-diphenylmethane diisocyanate, and triphenylmethane triisocyanate. An adduct of the above-mentioned isocyanate compound with hexanetriol can be employed.

In the aforementioned intermediate layer, it is preferable that the mixing ratio of the isocyanate compound to the resin having a hydroxyl group be 0.2 to 2.0 in terms of the molar ratio of NCO/OH.

The coating amount of the intermediate layer and that of the dye receiving layer provided on the substrate A are preferably 0.1 to 20 g/m$^2$ on a basis of dry solids content.

Other features of this invention will become apparent in the course of the following description of exemplary embodiments, which are given for illustration of the invention and are not intended to be limiting thereof.

EXAMPLE 1

A silicone type pressure-sensitive adhesive (Trademark "Trefirm SD4570", made by Dow Corning Toray Silicone Co., Ltd.) was coated onto a white polyethylene terephthalate (PET) film (Trademark "E20", made by Toray Industries, Inc.) with a thickness of 50 μm, in a deposition amount of 5 g/m$^2$ on a dry basis by a roll coater. The same 50-μm-thick white polyethylene terephthalate film as employed above was overlaid on the surface of the above silicone type pressure-sensitive adhesive, so that a substrate comprising two laminated sheets was obtained.

Subsequently, a dye receiving layer coating liquid with the following formulation was coated onto the above prepared substrate by a wire bar, and then dried at 100° C. for one minute, so that a dye receiving layer with a thickness of 3 μm was formed on the substrate. Thus, an image receiving medium according to the present invention was obtained.

| [Dye Receiving Layer Coating Liquid] | Parts by Weight |
|---|---|
| Saturated copolymerized polyester resin (Trademark "Vylon 200", made by Toyobo Co., Ltd.) | 100 |
| Polyester-modified silicone resin (Trademark "AY42-125", made by Dow Corning Toray Silicone Co., Ltd.) | 5 |
| Toluene | 300 |
| Methyl ethyl ketone | 300 |

A sublimation type thermal image transfer recording medium was prepared by the following method.

A silicone cured resin film, serving as a heat-resistant layer, with a thickness of about 1 μm was provided on one side of a polyethylene terephthalate film with a thickness of 6 μm.

On the reverse side of the polyethylene terephthalate film, a dye transfer layer coating liquid with the following formulation was coated in a thickness of about 2 μm, so that a thermal image transfer recording medium was obtained.

| [Dye Transfer Layer Coating Liquid] | Parts by Weight |
|---|---|
| Polyvinyl butyral resin (Trademark "BX-1", made by Sekisui Chemical Co., Ltd.) | 10 |
| Cyan sublimable disperse dye (Trademark "Kayaset Blue 714", made by Nippon Kayaku Co., Ltd.) | 6 |
| Methyl ethyl ketone | 95 |
| Toluene | 95 |

The above prepared thermal image transfer recording medium was superposed on the image receiving medium of the present invention with the dye transfer layer of the image transfer recording medium facing the dye receiving layer of the image receiving medium. The thermal recording test was performed in such a manner that the thermal energy was applied to the heat-resistant layer of the thermal image transfer recording medium by using a thermal head, with the level of the thermal energy changed. The recording density of the thermal head was 6 dots/mm, and the recording output power was 0.42 W/dot. After the thermal recording was performed, the curling degree of the image receiving medium was evaluated in accordance with the method to be described later. The results are shown in Table 1.

COMPARATIVE EXAMPLE 1

The procedure for preparation of the image receiving medium as employed in Example 1 was repeated except that the substrate comprising two laminated sheets employed in Example 1 was replaced by a single-layered substrate, that is, a 100-μm-thick white polyethylene terephthalate film (Trademark "E20", made by Toray Industries, Inc.), so that a comparative image receiving medium was obtained.

The thermal recording test was performed by the same method as in Example 1 using the thermal image transfer recording medium prepared in the same manner as in Example 1 and the above prepared comparative image receiving medium. After the thermal recording was performed, the curling degree of the comparative image receiving medium was measured. The results are shown in Table 1.

EXAMPLE 2

The procedure for preparation of the image receiving medium as employed in Example 1 was repeated except that the white PET film on which the dye receiving layer was provided in Example 1 was replaced by a polypropylene film (Trademark "Tosero-polypro-film OP#60U-1", made by Tokyo Serofan Co., Ltd.) with a thickness of 60 μm. Thus, an image receiving medium according to the present invention was obtained.

The thermal recording test was performed by the same method as in Example 1 using the thermal image transfer recording medium prepared in the same manner as in Example 1 and the above prepared image receiving medium of the present invention. After the thermal recording was performed, the curling degree of the image receiving medium according to the present invention was measured. The results are shown in Table 1.

EXAMPLE 3

The procedure for preparation of the image receiving medium as employed in Example 1 was repeated except that the white PET film on which the dye receiving layer was provided in Example 1 was replaced by an air-bubble-containing polyethylene terephthalate film (Trademark "E65", made by Toray Industries, Inc.) with a thickness of 50 μm. Thus, an image receiving medium according to the present invention was obtained.

The thermal recording test was performed by the same method as in Example 1 using the thermal image transfer recording medium prepared in the same manner as in Example 1 and the above prepared image receiving medium of the present invention. After the thermal recording was performed, the curling degree of the image receiving medium according to the present invention was measured. The results are shown in Table 1.

EXAMPLE 4

The procedure for preparation of the image receiving medium as employed in Example 1 was repeated except that the silicone type pressure-sensitive adhesive coated in a deposition amount of 5 g/m$^2$ in Example 1 was replaced by a two-part elastic adhesive (Trademark "EP-001", made by Cemedine Co., Ltd.) in a deposition amount of 10 g/m$^2$ on a dry basis. Thus, an image receiving medium according to the present invention was obtained.

The thermal recording test was performed by the same method as in Example 1 using the thermal image transfer recording medium prepared in the same manner as in Example 1 and the above prepared image receiving medium of the present invention. After the thermal recording was performed, the curling degree of the image receiving medium according to the present invention was measured. The results are shown in Table 1.

EXAMPLE 5

The procedure for preparation of the image receiving medium as employed in Exmple 1 was repeated except that the white PET film on which the dye receiving layer was provided in Example 1 was replaced by an air-bubble-containing polypropylene film (Trademark "Toyo Pearl-SS", made by Toyobo Co., Ltd.) with a thickness of 50 μm. Thus, an image receiving medium according to the present invention was obtained.

The thermal recording test was performed by the same method as in Example 1 using the above thermal image transfer recording medium prepared in the same manner as in Example 1 and the above prepared image receiving medium of the present invention. After the thermal recording was performed, the curling degree of the image receiving medium according to the present invention was measured. The results are shown in Table 1.

EXAMPLE 6

A two-part elastic adhesive (Trademark "EP-001", made by Cemedine Co., Ltd.) was coated onto a white polyethylene terephthalate film (Trademark "E20", made by Toray Industries, Inc.) with a thickness of 50 μm, in a deposition amount of 10 g/m$^2$ on a dry basis by a roll coater. An air-bubble-containing polyethylene terephthalate film (Trademark "E65", made by Toray Industries, Inc.) with a thickness of 50 μm was overlaid on the above two-part elastic adhesive, so that a substrate comprising the two laminated sheets was obtained.

Subsequently, the same coating liquid for a dye receiving layer as employed in Example 1 was coated onto the above prepared air-bubble-containing polyethylene terephthalate film by a wire bar, and then dried at 100° C. for one minute, so that a dye receiving layer with a thickness of 3 μm was formed on the substrate. Thus, an image receiving medium according to the present invention was obtained.

The thermal recording test was performed by the same method as in Example 1 using the thermal image transfer recording medium prepared in the same manner as in Example 1 and the above prepared image receiving medium of the present invention. After the thermal recording was performed, the curling degree of the image receiving medium according to the present invention was measured. The results are shown in Table 1.

EXAMPLE 7

The procedure for preparation of the image receiving medium as employed in Example 1 was repeated except that the two 50-μm-thick white polyethylene terephthalate films and the silicone type pressure-sensitive adhesive employed in Example 1 were respectively replaced by two 50-μm-thick air-bubble-containing polyethylene terephthalate films (Trademark "E65", made by Toray Industries, Inc.) and a two-part elastic adhesive (Trademark "EP-001", made by Cemedine Co., Ltd.). Thus, an image receiving medium according to the present invention was obtained.

The thermal recording test was performed by the same method as in Example 1 using the thermal image transfer recording medium prepared in the same manner as in Example 1 and the above prepared image receiving medium of the present invention. After the thermal recording was performed, the curling degree of the image receiving medium according to the present invention was measured. The results are shown in Table 1.

TABLE 1

| | Degree of Curling (mm) (*) |
|---|---|
| Ex. 1 | 14 |
| Ex. 2 | 12 |
| Ex. 3 | 10 |
| Ex. 4 | 10 |
| Ex. 5 | 9 |
| Ex. 6 | 6 |
| Ex. 7 | 15 |
| Com. Ex. 1 | 48 |

(*) The image receiving medium (A4 size) was put on a plane surface with the dye receiving layer being at the top of the image receiving medium. The height from the plane surface to the dye receiving layer of the image receiving medium was measured, and the degree of curling was expressed by the maximum value of the obtained height.

EXAMPLES 8 and 17 and COMPARATIVE EXAMPLES 2 to 3

The procedure for preparation of the image receiving medium of the present invention as employed in Example 1 was repeated except that the two white polyethylene terephthalate films (Trademark "E20", made by Toray Industries, Inc.) with a thickness of 50 μm, serving as a first laminated sheet and a second laminated sheet of a substrate were respectively replaced by the following materials for a first laminated sheet on which the dye receiving layer was provided, and a second laminated sheet shown in Table 2, so that image receiving media according to the present invention and comparative receiving media were obtained.

The thermal recording test was performed by the same method as in Example 1 using the thermal image transfer recording medium prepared in the same manner as in Example 1 and each of the above prepared image receiving media. After the thermal recording was performed, the curling degree of each image receiving medium was measured and the results thereof are shown in Table 2.

TABLE 2

| | First Laminated Sheet | Second Laminated Sheet | Degree of Curling (mm) |
|---|---|---|---|
| Ex. 8 | Coated paper (Trademark "OK Coat", made by Oji Paper Co., Ltd.) with a thickness of 100 μm | Coated paper (Trademark "OK Coat", made by Oji Paper Co., Ltd.) with a thickness of 100 μm | 15 |
| Ex. 9 | Coated paper (Trademark "OK Coat", made by Oji Paper Co., Ltd.) with a thickness of 80 μm | Coated paper (Trademark "OK Coat", made by Oji Paper Co., Ltd.) with a thickness of 80 μm | 21 |
| Ex. 10 | Coated paper (Trademark "OK Coat", made by Oji Paper Co., Ltd.) with a a thickness of 60 μm | Synthetic paper (Trademark "Yupo FPG100", made by Oji-Yuka Synthetic Co., Ltd.) with a thickness of 100 μm | 16 |
| Ex. 11 | Synthetic paper (Trademark "Yupo FPG80", made by Oji-Yuka Synthetic Co., Ltd.) with a thickness of 80 μm | Synthetic paper (Trademark "Yupo FPG80", made by Oji-Yuka Synthetic Co., Ltd.) with a thickness of 80 μm | 25 |
| Ex. 12 | Synthetic paper (Trademark "Yupo FPG95", made by Oji-Yuka Synthetic Co., Ltd.) with a Clarke hardness of 32 | Synthetic paper (Trademark "Yupo FPG95", made by Oji-Yuka Synthetic Co., Ltd.) with a Clarke hardness of 32 | 20 |
| Ex. 13 | Same as above | Synthetic paper (Trademark "Super Art", made by Oji-Yuka Synthetic Co., Ltd.) with a Clarke hardness of 49 | 11 |
| Ex. 14 | Polypropylene film (Trademark "YP56", made by Toray Industries, Inc.) with a heat shrinkage ratio of 30% | Polypropylene film (Trademark "YP56", made by Toray Industries, Inc.) with a heat shrinkage ratio of 30% | 31 |
| Ex. 15 | Same as above | White polyethylene terephthalate film (Trademark "E60", made by Tory Industries, Inc.) with a heat shrinkage ratio of 1.7% | 13 |
| Ex. 16 | Synthetic paper (Trademark "Yupo FPG80", made by Oji-Yuka Synthetic | Polypropylene film (Trademark "YP56", made by Toray Industries, | 30 |

TABLE 2-continued

| | First Laminated Sheet | Second Laminated Sheet | Degree of Curling (mm) |
|---|---|---|---|
| | Co., Ltd.) with a thermal conductivity of $2 \times 10^{-4}$ | Inc.) with a thermal conductivity of $4 \times 10^{-4}$ | |
| Ex. 17 | Same as above | White polyethylene terephthalate film (Trademark "YP56", made by Toray Industries, Inc.) with a thermal conductivity of $4 \times 10^{-4}$ | 15 |
| Com. Ex. 2 | Coated paper (Trademark "OK Coat", made by Oji Paper Co., Ltd.) with a thickness of 160 μm | — | 43 |
| Com. Ex. 3 | Synthetic paper (Trademark "Yupo FPG175", made by Oji-Yuka Synthetic Co., Ltd.) with a thickness of 175 μm | — | 60 |

EXAMPLE 18

A calcium carbonate-containing polyolefin film of biaxially oriented multi-layered type (Trademark "Yupo FPG80", made by Oji-Yuka Synthetic Co., Ltd.) with a thickness of about 80 μm and a heat shrinkage ratio of about 0.5%, serving as a first laminated sheet of a substrate, was attached by dry lamination to one side of a white polyethylene terphthalate film (Trademark "E20", made by Toray Industries, Inc.) with a thickness of about 10 μm, serving as a second laminated sheet of a substrate, with an acrylic type adhesive (Trademark "Polishik 370-S", made by Sanyo Chemical Industries, Ltd.), so that an adhesive layer with a thickness of about 5 μm was interposed between the first and second laminated sheets.

To the reverse side of the white PET film, opposite to the first laminated sheet with respect to the white PET film, the same polyolefin film as used as the first laminated sheet was attached by dry lamination with a polyester type adhesive (Trademark "S-3911", made by Toagosei Chemical Industry Co., Ltd.), so that an adhesive layer with a thickness of about 3 μm was interposed between the second and third laminated sheets. Thus, a substrate comprising three laminated sheets for an image receiving medium according to the present invention was obtained.

Subsequently, the same coating liquid for a dye receiving layer as used in Example 1 was coated onto the above prepared first laminated sheet of the substrate by a wire bar, then dried at 80° C. for one minute, and further subjected to aging at 60° C. for 2 hours, so that a dye receiving layer with a thickness of about 3 μm was formed. Thus, an image receiving medium according to the present invention was obtained.

The same thermal image transfer recording medium as used in Example 1 was superposed on the above prepared image receiving medium of the present invention with the dye transfer layer of the thermal image transfer recording medium facing the dye receiving layer of the image receiving medium. The thermal recording test was performed in such a manner that the thermal energy was applied to the heat-resistant layer of the thermal image transfer recording medium by using a thermal head, with the level of the thermal energy changed. The recording density of the thermal head was 12 dots/mm, and the recording output power was 0.42 W/dot.

After the thermal recording was performed, the curling degree of the image receiving medium was 17 mm.

EXAMPLE 19

A silicone type pressure-sensitive adhesive Trademark "Trefirm SD4570", made by Dow Corning Toray Silicone Co., Ltd.) was coated onto an air-bubble-containing polyester film (Trademark "E60", made by Toray Industries, Inc.) with a thickness of 50 μm in a deposition amount of 10 g/m$^2$ on a dry basis by a roll coater, and a sheet of a synthetic paper (Trademark "Yupo", made by Oji-Yuka Synthetic Co., Ltd.) with a thickness of 100 μm was overlaid on the silicone type pressure-sensitive adhesive, so that a substrate comprising two laminated sheets was obtained. In this case, the density $D_2$ of the above air-bubble-containing film and the density $D_1$ of an air-bubble free film made of the same material as that of the air-bubble-containing film were in the relationship of:

$$\frac{(D_1 - D_2)}{D_1} = 0.38.$$

Subsequently, a dye receiving layer coating liquid with the following formulation was coated onto the above prepared air-bubble-containing polyester film, serving as a first laminated sheet of the substrate, and then dried at 100° C. for one minute, so that a dye receiving layer with a thickness of 5 μm was formed. Thus, an image receiving medium according to the present invention was obtained.

| [Dye Receiving Layer Coating Liquid] | Parts by Weight |
|---|---|
| Vinyl chloride - vinyl acetate copolymer (Trademark "VYHH", made by Union Carbide Japan K.K.) | 20 |
| Alcohol-modified silicone oil (Trademark "SF8427", made by Dow Corning Toray Silicone Co., Ltd.) | 2 |
| Toluene | 40 |
| Methyl ethyl ketone | 40 |

The same thermal image transfer recording medium employed in Example 1 was superposed on the above prepared image receiving medium with the dye transfer layer of the thermal image transfer recording medium facing the dye receiving layer of the image receiving medium. The recording test was performed in such a manner that the thermal energy was applied to the heat-resistant layer of the sublimation type image transfer recording medium by using a thermal head, with the level of the thermal energy changed. The recording density of the thermal head was 6 dots/mm, and the recording output power was 0.42 W/dot.

After the thermal recording was performed, the curling degree of the image receiving medium was 14 mm.

The dot reproducibility of an image thermally transferred to the image receiving medium was excellent, and a high density image was obtained even when the thermal energy applied by the thermal head was small.

EXAMPLE 20

An expanded polyethylene terephthalate film (Trademark "E60", made by Toray Industries, Inc.) with a thickness of about 50 μm and a heat shrinkage ratio of 1.0% in the lengthwise direction and that of 1.8% in the crosswise direction, serving as a first laminated sheet of a substrate, and a white polyethylene terephthalate film (Trademark "E20", made by Toray Industries, Inc.) with a thickness of about 100 μm, serving as a second laminated sheet of a substrate, were laminated with an acrylic acid ester copolymer type adhesive (Trademark "Oribain BPS5454", made by Toyo Ink Mfg. Co., Ltd.), so that an adhesive layer with a thickness of about 3 μm was interposed between the first and second laminated sheets.

To the reverse side of the white PET film, opposite to the first laminated sheet with respect to the white PET film, the same expanded polyethylene terephthalate film as used as the first laminated sheet, was attached with the same adhesive layer as used above interposed between the second and third laminated sheets. Thus, a substrate comprising three laminated sheets for an image receiving medium according to the present invention was obtained.

Subsequently, the same coating liquid for a dye receiving layer as used in Example 1 was coated onto the above prepared first laminated sheet of the substrate by a wire bar, then dried at 80° C. for one minute, and further subjected to aging at 60° C. for 2 hours, so that a dye receiving layer with a thickness of about 3 μm was formed. Thus, an image receiving medium according to the present invention was obtained.

Furthermore, a sublimation type thermal image transfer recording medium was prepared by the following method.

A silicone resin heat-resistant layer with a thickness of 1 μm was provided on one side of a polyethylene terephthalate film with a thickness of 6 μm. On the reverse side of the PET film, opposite to the heat-resistant protective layer with respect to the PET film, each dye transfer layer coating liquid with the following formulation was coated by a wire bar in a thickness of 2.0 μm, and then dried. Thus, thermal image transfer recording media with a yellow color, magenta color and cyan color were obtained.

| | Parts by Weight |
|---|---|
| [Yellow Dye Transfer Layer Coating Liquid] | |
| Polyvinyl butyral resin (Trademark "BX-1", made by Sekisui Chemical Co., Ltd.) | 10 |
| Yellow sublimable dye (Trademark "Yellow VP", made by Mitsui Toatsu Dyes, Ltd.) | 4 |
| Toluene | 95 |
| Methyl ethyl ketone | 95 |
| [Magenta Dye Transfer Layer Coating Liquid] | |
| Polyvinyl butyral resin (Trademark "BX-1", made by Sekisui Chemical Co., Ltd.) | 10 |
| Magenta sublimable dye (Trademark "Magenta VP", made by Mitsui Toatsu Dyes, Ltd. | 10 |
| Toluene | 95 |
| Methyl ethyl ketone | 95 |
| [Cyan Dye Transfer Layer Coating Liquid] | |
| Polyvinyl butyral resin (Trademark "BX-1", made by Sekisui Chemical Co., Ltd.) | 10 |
| Cyan sublimable dye (Trademark "Cyan VP", made by Mitsui Toatsu Dyes, Ltd.) | 10 |
| Toluene | 95 |
| Methyl ethyl ketone | 95 |

Each of the above prepared thermal image transfer recording media with yellow, magenta, and cyan, was in turn superimposed upon the image receiving medium and thermal transfer recording was carried out to obtain a solid black image, with the dye transfer layer of each image transfer recording medium facing the dye receiving layer of the image receiving medium. The thermal recording test was performed in such a manner that the thermal energy was applied to the back side of the sublimation type image transfer recording medium by using a thermal head, with the level of the thermal energy changed. The recording density of the thermal head was 12 dots/mm, and the recording output power was 0.64 mj/dot. After the thermal recording was performed, the curling degree of the image receiving medium was 19 mm. The image reproducibility of an image with a low density obtained on the image receiving medium was excellent.

EXAMPLE 21

A calcium carbonate-containing polyolefin film of biaxially oriented multi-layered type (Trademark "Yupo FPG80", made by Oji-Yuka Synthetic Co., Ltd.) with a thickness of about 80 μm and a heat shrinkage ratio of about 0.5%, serving as a first laminated sheet of a substrate, was attached to one side of a white poyethylene terephthalate film Trademark "E20", made by Toray Industries, Inc.) with a thickness of about 50 μm, serving as a second laminated sheet of a substrate, with an adhesive with the following formulation, so that a 15-μm-thick adhesive layer was interposed between the first and second laminated sheets.

| [Formulation of Adhesive between First and Second Laminated Sheets] | |
|---|---|
| | Parts by Weight |
| Polyoxytetramethylene glycol polymer with a molecular weight of about 4,000 represented by the following general formula: | 100 |

-continued

| [Formulation of Adhesive between First and Second Laminated Sheets] | |
|---|---|
| | Parts by Weight |
| $(CH_3O)_2\overset{CH_3}{\overset{\vert}{Si}}CH_2CH_2CH_2O\text{-}(CH_2CH_2CH_2CH_2O)_n\text{-}CH_2CH_2CH_2\overset{CH_3}{\overset{\vert}{Si}}(OCH_3)_2$ | |
| Epoxy resin (Trademark "Epicote 828", made by Yuka Shell Epoxy Kabushiki Kaisha) | 20 |
| 2,4,6-tris-(dimethylamino-methyl)phenol | 2 |
| Tin octylate | 3 |
| Laurylamine | 0.75 |

To the reverse side of the white PET film, opposite to the first laminated sheet with respect to the white PET film, the same polyolefin film as used as the first laminated sheet, was attached with a polyester type adhesive (Trademark "S-3911", made by Toagosei Chemical Industry Co., Ltd.), so that an adhesive layer with a thickness of about 3 μm was interposed between the second and third laminated sheets. Thus, a substrate comprising three laminated sheets for an image receiving medium according to the present invention was obtained.

Subsequently, the same coating liquid for a dye receiving layer as used in Example 1 was coated onto the above prepared first laminated sheet of the substrate by a wire bar, then dried at 80° C. for one minute, and further subjected to aging at 60° C. for 2 hours, so that a dye receiving layer with a thickness of about 3 μm was formed. Thus, an image receiving medium according to the present invention was obtained.

The thermal recording test was performed by the same method as in Example 1 using the thermal image transfer recording medium prepared in the same manner as in Example 1 and the above prepared image receiving medium according to the present invention. The recording density of the thermal head was 12 dots/mm, and the recording output power was 0.42 W/dot.

After the thermal recording was performed, the curling degree of the image receiving medium was 14 mm.

EXAMPLE 22

An acrylic plastic adhesive (Trademark "Polishik 370-S", made by Sanyo Chemical Industries, Ltd.) was coated by gravure coating onto a white polyethylene terephthalate (Trademark "E20", made by Toray Industries, Inc.) with a thickness of 50 μm so as to partially provide a plastic adhesive layer with a thickness of 3 μm in such a pattern as shown in FIG. 4(*c*). The same 50-μm-thick white PET film as employed above was overlaid on the surface of the above acrylic plastic adhesive layer, so that a substrate comprising two laminated sheets was obtained.

Subsequently, the same coating liquid for a dye receiving layer as used in Example 1 was coated onto either PET film by a wire bar, and then dried at 100° C. for one minutes, so that a dye receiving layer with a thickness of 3 μm was formed on the substrate. Thus, an image receiving medium according to the present invention was obtained.

The thermal recording test was performed by the same method as in Example 1 using the thermal image transfer recording medium prepared in the same manner as in Example 1 and the above prepared image receiving medium. The recording density of the thermal head was 6 dots/mm, and the recording output power was 0.42 W/dot. After the thermal recording was performed, the curling degree of the image receiving medium was 14 mm.

EXAMPLE 23

A silicone type pressure-sensitive adhesive (Trademark "Trefirm SD4570", made by Dow Corning Toray Silicone Co., Ltd.) was coated onto a transparent polyethylene terephthalate film (Trademark "Lumirror T60", made by Toray Industries, Inc.) with a thickness of 50 μm, in a deposition amount of 5 g/m$^2$ on a dry basis by a roll coater. The same 50-μm-thick transparent polyethylene terephthalate film as employed above was overlaid on the surface of the above silicone type pressure-sensitive adhesive, so that a transparent substrate comprising laminated sheets was obtained.

Subsequently, the same coating liquid for a dye receiving layer as used in Example 1 was coated onto either PET film by a wire bar, and then dried at 100° C. for one minute, so that a dye receiving layer with a thickness of 3 μm was formed on the substrate. Thus, an image receiving medium according to the present invention was obtained.

The thermal recording test was performed by the same method as in Example 1 using the thermal image transfer recording medium prepared in the same manner as in Example 1 and the above prepared transparent image receiving medium. The recording density of the thermal head was 6 dots/mm, and the recording output power was 0.42 W/dot. After the thermal recording was performed, the curling degree of the transparent image receiving medium according to the present invention was 12 mm.

COMPARATIVE EXAMPLE 4

The procedure for preparation of the transparent image receiving medium as employed in Example 23 was repeated except that the transparent substrate comprising two laminated sheets employed in Example 23 was replaced by a single-layered transparent substrate, that is, a 100-μm-thick transparent polyethylene terephthalate film (Trademark "Lumirror T60", made by Toray Industries, Inc.), so that a comparative transparent image receiving medium was obtained. The thermal recording test was performed by the same method as in Example 1 using the thermal image transfer recording medium prepared in the same manner as in Example 1 and the above prepared comparative transparent image receiving medium. After the thermal recording was performed, the curling degree of the comparative transparent image receiving medium was 52 mm.

EXAMPLE 24

The procedure for preparation of the transparent image receiving medium as employed in Example 23 was repeated except that the transparent PET film (Trademark "Lumirror T60") on which the dye receiving layer was provided in Example 23 was replaced by a transparent polypropylene film (Trademark "Toserolypro-film OP#60U-1", made by Tokyo Serofan Co., Ltd.) with a thickness of 60 μm. Thus a transparent image receiving medium was obtained.

The thermal recording test was performed by the same method as in Example 1 using the thermal image transfer recording medium prepared in the same manner as in Example 1 and the above prepared transparent image receiving medium. After the thermal recording was performed, the curling degree of the transparent image receiving medium according to the present invention was 10 mm.

EXAMPLE 25

The procedure for preparation of the transparent substrate of the transparent image receiving medium as employed in Example 23 was repeated.

Subsequently, an intermediate layer coating liquid A with the following formulation was coated onto the above prepared transparent substrate by a wire bar, and then dried at 100° C. for one minute, so that an intermediate layer with a thickness of 0.2 μm was formed on the transparent substrate.

| [Intermediate Layer Coating Liquid A] | Parts by Weight |
|---|---|
| Polyester resin (Trademark "Vylon 200", made by Toyobo Co., Ltd.) | 100 |
| Toluene | 450 |
| Methyl ethyl ketone | 450 |

Furthermore, a dye receiving layer coating liquid B with the following formulation was coated onto the above prepared intermediate layer, and then dried at 100° C. for one minute, so that a dye receiving layer was formed on the intermediate layer. Thus, an image receiving medium according to the present invention was obtained.

| [Dye Receiving Layer Coating Liquid B] | Parts by Weight |
|---|---|
| Vinyl chloride - vinyl acetate copolymer (Trademark "VYHH", made by Union Carbide Japan K.K. | 100 |
| Polyester-modified silicone resin (Trademark "AY42-125", made by Dow Corning Toray Silicone Co., Ltd.) | 5 |
| Toluene | 300 |
| Methyl ethyl ketone | 300 |

The thermal recording test was performed by the same method as in Example 1 using the thermal image transfer recording medium prepared in the same manner as in Example 1 and the above prepared transparent image receiving medium. The recording density of the thermal head was 6 dots/mm, and the recording output power was 0.42 W/dot. After the thermal recording was performed, the curling degree, adhesion between the substrate and the dye receiving layer, and releasability of the transparent image receiving medium according to the present invention from the dye transfer layer of the thermal image transfer recording medium were evaluated. The results are shown in Table 3.

COMPARATIVE EXAMPLE 5

The procedure for preparation of the transparent image receiving medium as employed in Example 25 was repeated except that the transparent substrate comprising two laminated sheets employed in Example 25 was replaced by a single-layered transparent substrate, that is, a 100-μm-thick transparent polyethylene terephthalate film (Trademark "Lumirror T60", made by Toray Industries, Inc.), and that the intermediate layer was eliminated, so that a comparative transparent image receiving medium was obtained.

The thermal recording test was performed by the same method as in Example 1 using the thermal image transfer recording medium prepared in the same manner as in Example 1 and the above prepared comparative transparent image receiving medium. After the thermal recording was performed, the curling degree, adhesion between the substrate and the dye receiving layer, and releasability of the comparative transparent image receiving medium from the dye transfer layer of the thermal image transfer recording medium were evaluated. The results are shown in Table 3.

EXAMPLE 26

The procedure for preparation of the transparent image receiving medium as employed in Example 25 was repeated except that the thickness of the intermediate layer was changed from 0.2 μm to 0.5 μm, so that a transparent image receiving medium according to the present invention was obtained.

The thermal recording test was performed by the same method as in Example 1 using the thermal image transfer recording medium prepared in the same manner as in Example 1 and the above prepared transparent image receiving medium of the present invention. After the thermal recording was performed, the curling degree, adhesion between the substrate and the dye receiving layer, and releasability of the transparent image receiving medium according to the present invention from the dye transfer layer of the thermal image transfer recording medium were evaluated. The results are shown in Table 3.

EXAMPLE 27

The procedure for preparation of the transparent image receiving medium as employed in Example 25 was repeated except that the intermediate layer coating liquid B used in Example 25 was replaced by an intermediate layer coating liquid C with the following formulation, so that a transparent image receiving medium according to the present invention was obtained.

The thermal recording test was performed by the same method as in Example 1 using the thermal image transfer recording medium prepared in the same manner as in Example 1 and the above prepared transparent image receiving medium of the present invention. After the thermal recording was performed, the curling degree, adhesion between the substrate and the dye receiving layer, and releasability of the transparent image receiving medium according to the present invention from the dye transfer layer of the thermal image transfer recording medium were evaluated. The results are shown in Table 3.

| [Intermediate Layer Coating Liquid C] | Parts by Weight |
|---|---|
| Polyester resin (Trademark "Vylon 200", made by Toyobo Co., Ltd.) | 100 |
| Isocyanate compound (Trademark "Burnock DN-950", made by Dainippon Ink & Chemicals, Incorporated) | 10 |
| Toluene | 450 |
| Methyl ethyl ketone | 450 |

EXAMPLE 28

The procedure for preparation of the transparent image receiving medium as employed in Example 25 was repeated except that the intermediate layer coating liquid B used in Example 25 was replaced by the intermediate layer coating liquid C used in Example 27, and that the thickness of the intermediate layer was changed from 0.2 μm to 1.0 μm, so that a transparent image receiving medium according to the present invention was obtained.

The thermal recording test was performed by the same method as in Example 1 using the thermal image transfer recording medium prepared in the same manner as in Example 1 and the above prepared transparent image receiving medium of the present invention. After the thermal recording was performed, the curling degree, adhesion between the substrate and the dye receiving layer, and releasability of the transparent image receiving medium according to the present invention from the dye transfer layer of the thermal image transfer recording medium were evaluated. The results are shown in Table 3.

TABLE 3

| | Degree of Curling (mm) (*) | Adhesion (**) | Releasability (***) |
|---|---|---|---|
| Ex. 25 | 11 | good | good |
| Ex. 26 | 8 | excellent | good |
| Ex. 27 | 7 | excellent | excellent |
| Ex. 28 | 4 | excellent | excellent |
| Com. Ex. 5 | 51 (image receiving medium was not smoothly discharged from the recording apparatus) | dye receiving layer was peeled from substrate | strong force was required to release the image receiving medium from the image recording medium |

(*) Measured in the same manner as previously mentioned.
(**) Adhesion between the substrate and the dye receiving layer.
(***) Releasability of the dye receiving layer of the image receiving medium from the dye transfer layer of the thermal image transfer recording medium after the thermal recording.

As previously explained, since the dye receiving layer is provided on the substrate which is prepared by laminating at least two sheets with the elastic or plastic adhesive layer interposed between those sheets in the sublimation type thermal image transfer image receiving medium of the present invention, the curling of the image receiving medium can be prevented when the thermal energy is applied thereto in the thermal image transfer recording operation. As a result, the transporting performance of the image receiving medium is satisfactory. In addition, the image receiving medium of the present invention is not subject to the storage conditions after image recording.

When the sublimation type thermal image transfer image receiving medium of the present invention is used as a transparent image receiving medium for use with the OHP, the image receiving medium can be used as it is after images are thermally transferred thereto, which facilitates the handling. The curling problem can also be solved in this case, and therefore the image projected by use of the OHP is not distorted.

What is claimed is:

1. A sublimation thermal image transfer image receiving medium, comprising a substrate and a dye receiving layer formed thereon, said substrate comprising a first laminated sheet on which said dye receiving layer is provided and a second laminated sheet, with an elastic adhesive layer or a plastic adhesive layer interposed between said first laminated sheet and said second laminated sheet, and wherein said first laminated sheet on which said dye receiving layer is provided is a void-containing film, which is an air-bubble containing film, wherein a density, $D_2$, of said air-bubble-containing film and a density, $D_1$, of an air-bubble free film made of the same material as that of said air-bubble-containing film have the relationship of:

$$\frac{D_1 - D_2}{D_2} > 0.30.$$

2. The sublimation thermal image transfer image receiving medium as claimed in claim 1, wherein said air-bubble-containing film has a heat shrinkage ratio of 6% or less in both the lengthwise direction and the crosswise direction when measured in accordance with JIS C-2318.

3. The sublimation thermal image transfer image receiving medium as claimed in claim 2, wherein said air-bubble-containing film has a heat shrinkage ratio of 2.5% or less in both the lengthwise direction and the crosswise direction.

4. The sublimation thermal image transfer image receiving medium as claimed in claim 2, wherein said air-bubble-containing film is made of a material selected from the group consisting of polyester and polypropylene.

5. The sublimation thermal image transfer image receiving medium as claimed in claim 1, further comprising at least one sheet which is attached to said second laminated sheet via an adhesive layer.

6. The sublimation thermal image transfer image receiving medium as claimed in claim 5, wherein said adhesive layer is an elastic adhesive layer or a plastic adhesive layer.

7. The sublimation thermal image transfer image receiving medium as claimed in claim 1, wherein said elastic adhesive layer or said plastic adhesive layer is partially interposed between said first laminated sheet and said second laminated sheet.

8. The sublimation thermal image transfer image receiving medium as claimed in claim 1, wherein said second laminated sheet is thicker than said first laminated sheet in which said dye receiving layer is provided.

9. The sublimation thermal image transfer image receiving medium as claimed in claim 1, wherein said second laminated sheet has a larger rigidity than that of said first laminated sheet on which said dye receiving layer is provided.

10. The sublimation thermal image transfer image receiving medium as claimed in claim 1, wherein said second laminated sheet has a smaller heat shrinkage ratio than that of said first laminated sheet on which said dye receiving layer is provided.

11. The sublimation thermal image transfer image receiving medium as claimed in claim 1, wherein said second laminated sheet has a larger thermal conductivity than that of said first laminated sheet on which said dye receiving layer is provided.

12. The sublimation thermal image transfer image receiving medium as claimed in claim 1, wherein said first and second laminated sheets comprise cellulose fiber paper.

13. The sublimation thermal image transfer image receiving medium as claimed in claim 1, wherein said elastic adhesive layer comprises a composition comprising a silanol condensation catalyst and a polyoxytetramethylene glycol based polymer having a silicon-atom-containing group capable of crosslinking by forming a siloxane bond.

14. The sublimation thermal image transfer image receiving medium as claimed in claim 1, wherein said elastic adhesive layer comprises the composition comprising a silanol condensation catalyst and a polyoxytetramethylene glycol based polymer having a silicon-atom-containing group capable of crosslinking by forming a siloxane bond.

15. The sublimation thermal image transfer image receiving medium as claimed in claim 1, wherein said dye receiving layer is a transparent dye receiving layer, and said first laminated sheet and said second laminated sheet are respectively a transparent first laminated film and a transparent second laminated film.

16. The sublimation thermal image transfer image receiving medium as claimed in claim 15, wherein the ratio of the thickness of said transparent second laminated film to that of said transparent first laminated film is 1.1 or less.

17. The sublimation thermal image transfer image receiving medium as claimed in claim 15, further comprising an intermediate layer which is interposed between said transparent dye receiving layer and said transparent said first laminated film.

18. The sublimation thermal image transfer image receiving medium as claimed in claim 17, wherein said intermediate layer comprises a hydroxyl-group-containing resin and an isocyanate compound.

19. The sublimation thermal image transfer image receiving medium as claimed in claim 1, wherein the substrate is made of a material selected from the group consisting of plastic and paper.

20. The sublimation thermal image transfer image receiving medium as claimed in claim 1, wherein said void-containing film is a biaxially-oriented multilayered film comprising a polyolefin resin acid and an inorganic pigment.

21. The sublimation thermal image transfer image receiving medium as claimed in claim 1, wherein said inorganic pigment is titanium dioxide or calcium carbonate and constituted 3 to 80% by weight of the total weight of the film.

22. The sublimation thermal image transfer image receiving medium as claimed in claim 1, wherein each of said laminated sheets constituting the substrate has a thickness of about 15 to 300 $\mu$m.

* * * * *

UNITED STATES PATENT AND TRADEMARK OFFICE

CERTIFICATE OF CORRECTION

PATENT NO. : 5,314,861

DATED : May 24, 1994

INVENTOR(S) : Naoya MOROHOSHI, et al.

It is certified that error appears in the above-identified patent and that said Letters Patent is hereby corrected as shown below:

Column 6, line 31, "ratio of 0.1% or in the" should read --ratio of 0.1% or less in the--.

Column 6, line 39, "about 5 to 300 μm," should read --about 15 to 300 μm,--.

Column 16, Table 2, Ex. 8, "thickness of 100 μm" should read --thickness of 60 μm--.

Column 23, line 37, "Carbide Japan K.K." should read --Carbide Japan K.K.)--.

Signed and Sealed this

Twelfth Day of September, 1995

*Attest:*

*Attesting Officer*

Bruce Lehman

BRUCE LEHMAN

*Commissioner of Patents and Trademarks*